US009979161B2

(12) United States Patent
Schimmel et al.

(10) Patent No.: US 9,979,161 B2
(45) Date of Patent: May 22, 2018

(54) SPARK PLUG HAVING REDUCED WEAR OF THE CENTER ELECTRODE AND METHOD OF MAKING SUCH A SPARK PLUG

(71) Applicant: Robert Bosch GmbH, Stuttgart (DE)

(72) Inventors: Chris Schimmel, Waiblingen (DE); Nicolai Claus, Ditzingen (DE)

(73) Assignee: ROBERT BOSCH GMBH, Stuttgart (DE)

( * ) Notice: Subject to any disclaimer, the term of this patent is extended or adjusted under 35 U.S.C. 154(b) by 0 days. days.

(21) Appl. No.: 15/527,237

(22) PCT Filed: Sep. 16, 2015

(86) PCT No.: PCT/EP2015/071187
§ 371 (c)(1),
(2) Date: May 16, 2017

(87) PCT Pub. No.: WO2016/078795
PCT Pub. Date: May 26, 2016

(65) Prior Publication Data

US 2017/0338629 A1 Nov. 23, 2017

(30) Foreign Application Priority Data

Nov. 20, 2014 (DE) ..... 10 2014 223 746

(51) Int. Cl.
*H01T 13/20* (2006.01)
*H01T 13/16* (2006.01)
(Continued)

(52) U.S. Cl.
CPC ..... *H01T 13/16* (2013.01); *H01T 21/02* (2013.01); *H01T 13/34* (2013.01)

(58) Field of Classification Search
CPC ..... H01T 21/02; H01T 13/39; H01T 13/38; H01T 13/20; H01T 13/34; H01T 13/36; H01T 13/467; H01T 13/52
See application file for complete search history.

(56) References Cited

U.S. PATENT DOCUMENTS

| | | | |
|---|---|---|---|
| 5,159,233 | A | 10/1992 | Sponseller et al. |
| 7,944,135 | B2 | 5/2011 | Walker, Jr. |
| 2012/0153799 | A1 | 6/2012 | Kameda |

FOREIGN PATENT DOCUMENTS

| | | | |
|---|---|---|---|
| EP | 1592101 | A2 | 11/2005 |
| EP | 2784883 | A1 | 10/2014 |

(Continued)

OTHER PUBLICATIONS

International Search Report dated Nov. 18, 2015, of the corresponding International Application PCT/EP2015/071187 filed Sep. 16, 2015.

*Primary Examiner* — Tracie Y Green
(74) *Attorney, Agent, or Firm* — Norton Rose Fulbright US LLP; Gerard Messina

(57) ABSTRACT

A spark plug with an improved heat-dissipating capacity of the center electrode. The spark plug includes a ground electrode, a center electrode and a ceramic insulator, which is designed to accommodate the center electrode. The center electrode has a center-electrode head which lies in the direction of an electrical connection region of the spark plug and which includes an end face that is in contact with an electrically conductive connection element disposed between the electrical connection region and the center-electrode head. At its outer periphery, the center-electrode head is at least regionally in heat-conducting contact with the ceramic insulator and forms a heat-conducting contact region.

15 Claims, 2 Drawing Sheets

(51) Int. Cl.
*H01T 21/02* (2006.01)
*H01T 13/34* (2006.01)

(56) References Cited

FOREIGN PATENT DOCUMENTS

| | | | |
|---|---|---|---|
| JP | H03225785 | A | 10/1991 |
| WO | 2012105255 | A1 | 8/2012 |

SPARK PLUG HAVING REDUCED WEAR OF THE CENTER ELECTRODE AND METHOD OF MAKING SUCH A SPARK PLUG

BACKGROUND INFORMATION

The present invention relates to a spark plug having reduced wear at the center electrode and to an easily implementable method for producing a spark plug.

Spark plugs in different configurations are generally available. PCT Application No. WO 2012/105255 A1 describes, for example, a spark plug having a center electrode and a ground electrode. The center electrode is situated in the insulator. An electrically conductive material establishes an electrical connection between the center electrode and an electrical connection region of the spark plug. The electrically conductive material surrounds a center-electrode head of the center electrode which is oriented in the direction of the electric connection region, and fills a gap between the center-electrode head and the insulator. The electrically conductive material acts as a thermal insulator and, for example, prevents or reduces a heat dissipation from the center electrode via the ceramic insulator to a cooled cylinder head which is in contact with a housing of the spark plug. The wear of such a spark plug is therefore high as the result of the thermal overloading.

SUMMARY

An example spark plug in accordance with the present invention has excellent thermal conduction between the center-electrode head and the ceramic insulator. This is possible because the outer periphery of the center-electrode head is at least regionally in heat-conducting contact with the ceramic insulator and forms a heat-conducting contact region. In other words, sections of the outer periphery of the center-electrode head are in thermally conductive contact with the ceramic insulator, so that a heat transfer from the center-electrode head to the insulator, and thus a heat dissipation from the center electrode, takes place at high rates. In this context it was found that an electrically conductive connection element provided for the electrical connection of the center-electrode head and the electrical connection region of the spark plug has poorer thermal conductivity than the ceramic insulator. Because of the heat-conducting contact region, the center-electrode head and the insulator are in excellent thermal connection so that a very satisfactory heat transfer is able to take place. The heat dissipation from the center-electrode head to the insulator may thus be carried out very rapidly and at high rates. The outstanding heat dissipation reduces the wear rate of the center electrode. In particular, there is an improvement in the heat dissipation from the center-electrode tip facing the combustion chamber, where the highest temperatures prevail due to the spark plasma, to the insulator and further to the usually cooled cylinder head. The material of the center electrode is thus less stressed and the service life of the spark plug according to the present invention is increased significantly.

Preferred further developments of the present invention are described herein.

For a further improvement in the heat dissipation from the center-electrode head to the insulator, an advantageous further refinement provides that the entire outer periphery of the center-electrode head forms a heat-conducting contact region with the ceramic insulator.

The thermal conduction can be further improved by a direct contact between the outer periphery of the center-electrode head and the insulator. In other words, there is no intermediate layer between the center-electrode head and the insulator, i.e. neither a thermally conductive intermediate layer nor an air layer. There is also no electrically conductive connection element in this region.

It is furthermore advantageous to avoid air gaps between the center-electrode head and the insulator. This is preferably achieved by forming a press-fit connection between the center-electrode head and the insulator.

In addition, in order to minimize heat-transfer losses by a convective flow, the heat-conducting contact region between the center-electrode head and the insulator is advantageously developed as a gas-tight region.

Given the smallest possible overall length of the center electrode, the heat-dissipation capacity of the spark plug according to the present invention is advantageously able to be increased in that the heat-conducting contact region has a length L of at least 1 mm and preferably of 1.5 to 4.5 mm in the axial direction X-X of the spark plug.

The heat-dissipation capacity through the heat-conducting contact region is able to be further increased by optimizing the relationship between the length of the center-electrode head and its diameter, and in particular, by having a diameter D of the center-electrode head in the heat-conducting contact region of at least 2 mm and, in particular, 2 to 4 mm.

Also advantageous for the heat-dissipation capacity is a ratio L/D of length L of the heat-conducting contact region and diameter D of the heat-conducting contact region that preferably amounts to at least 0.75.

Excellent gas-tight sealing of the combustion chamber as well as a centered support of the center-electrode head in the insulator, and thus a heat-dissipation capacity at a level that is especially uniform in all directions, is advantageously achieved in that a diameter of the center-electrode head is greater than a center-electrode section facing the combustion chamber. Furthermore, a shoulder that comes to rest on the insulator is developed in a transition region between the center-electrode head and the center-electrode section facing the combustion chamber. As a result, the shoulder of the center electrode is also in heat-conducting contact with the ceramic insulator.

Preferably, the center-electrode head of the center electrode is provided with a cup-like region on its end face. Moreover, the cup-like region preferably has a peripherally closed wall. Given a reduced volume of the center-electrode head, this results in an especially large outer periphery, which is beneficial for a heat transfer from the center-electrode head to the insulator.

Especially preferably, the center-electrode head is developed in the form of a cylindrical cup. This allows for a heat dissipation to the insulator at high rates, and one that is uniform in all directions.

Another advantageous further development is distinguished in that the center-electrode head has a multitude of jagged projections in the region of its outer periphery located in the heat-conducting contact region. This enlarges the surface of the heat-conducting contact region and thus allows for an even more effective heat dissipation.

An example method for producing a spark plug is also described according to the present invention. The method described below is particularly suitable for producing the spark plug described earlier. The method is able to be implemented very easily without great technical complexity, and thus in a cost-effective manner, by a combination of standard processes. As a first step, the method includes an introduction of a center electrode into a cavity of the ceramic insulator, so that the center-electrode head comes to lie on a shoulder developed in the cavity of the ceramic insulator. For this purpose, a diameter of the center-electrode head in particular is greater than a section of the center electrode that faces the combustion chamber and is situated underneath the shoulder developed in the insulator. As a further step, a press-fitting of the center electrode with the ceramic insulator is carried out. This seals the combustion chamber of the spark plug in a gas-tight manner with respect to the regions outside of the combustion chamber. In addition, the center-electrode head is thereby brought into direct contact with the ceramic insulator, so that a heat-conducting contact region is formed between an outer periphery of the center-electrode head and the ceramic insulator in an additional step. With the aid of the present method, a spark plug with a high capacity for dissipating heat from the center electrode to the ceramic insulator and further to a normally cooled cylinder head is able to be produced in a technically uncomplicated manner. The method is therefore implementable in a cost-effective manner without significant outlay. The spark plug produced in this manner is distinguished by excellent thermal stability, a low rate of wear of the center electrode, and thus by high durability.

The advantages described in connection with the spark plug according to the present invention also apply to the method for producing the spark plug according to the present invention.

The press-fitting is advantageously accomplished in a technically simple manner with the aid of a stamp. The stamp preferably has a shape that corresponds to the negative shape of the center-electrode head to be press-fit, with the result that a uniform force transfer is able to take place for the centered positioning and fastening of the center electrode in the ceramic insulator.

In addition, the method advantageously includes the step of introducing an electrically conductive connection element into the cavity of the ceramic insulator, so that the center-electrode head is connected to the electrical connection region of the spark plug in an electrically conductive manner. This is advantageously followed by superficially fusing the electrically conductive connection element, such as in a kiln, so that the thermally conductive placement and mounting of the center-electrode head is able to be locked in place.

BRIEF DESCRIPTION OF THE DRAWINGS

An exemplary embodiment of the present invention is described in detail below with reference to the figures.

DETAILED DESCRIPTION OF EXAMPLE EMBODIMENTS

Figure 1:
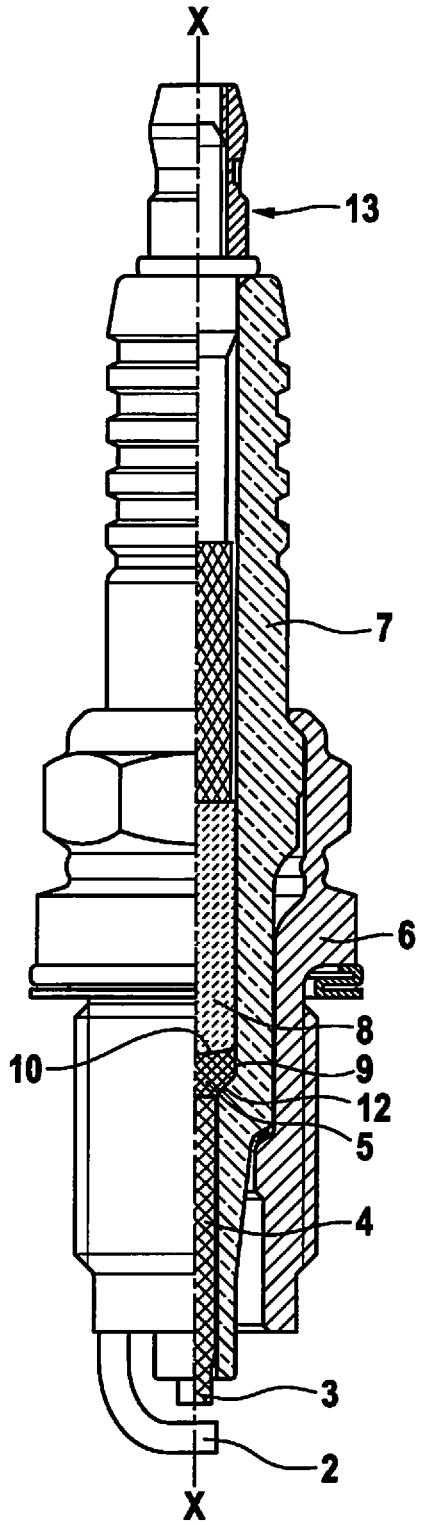
FIG. 1 a part-sectional view of a spark plug according to an advantageous further refinement of the present invention.

As shown in FIG. 1, spark plug 1 includes a ground electrode 2 and a center electrode 3. A ceramic insulator 7 is provided in such a way that center electrode 3 projects slightly from insulator 7 in the known manner. Center electrode 3 is made from one material but may also have a core-jacket structure, e.g., a jacket from a nickel-containing material and a core made from a copper-containing material, which improves a heat dissipation from the center-electrode base facing the combustion chamber to insulator 7. In addition, a noble metal pin for generating a spark plasma may be provided on the side of the combustion chamber.

Insulator 7 itself is partially surrounded by a housing 6. Reference numeral 13 denotes an electrical connection region of spark plug 1. An electrically conductive connection is provided from electrical connection region 13 to center electrode 3 via a connection stud and a connection element 8 made from an electrically conductive glass, for example.

Center electrode 3 has a center-electrode head 5, which points in the direction of electrically conductive connection element 8. An end face 10 of center-electrode head 5 is in contact with electrically conductive connection element 8.

A diameter of center-electrode head 5 is larger than a diameter of a center-electrode section 4 facing the combustion chamber. In a transition region between center-electrode head 5 and center-electrode section 4 facing the combustion chamber, a shoulder 12 is developed on center-electrode head 5, which comes to rest on a correspondingly developed section of insulator 7.

An outer periphery of center-electrode head 5 is in heat-conducting contact with ceramic insulator 7, so that a heat-conducting contact region 9 is developed between the outer periphery of center-electrode head 5 and ceramic insulator 7.

Figure 2:
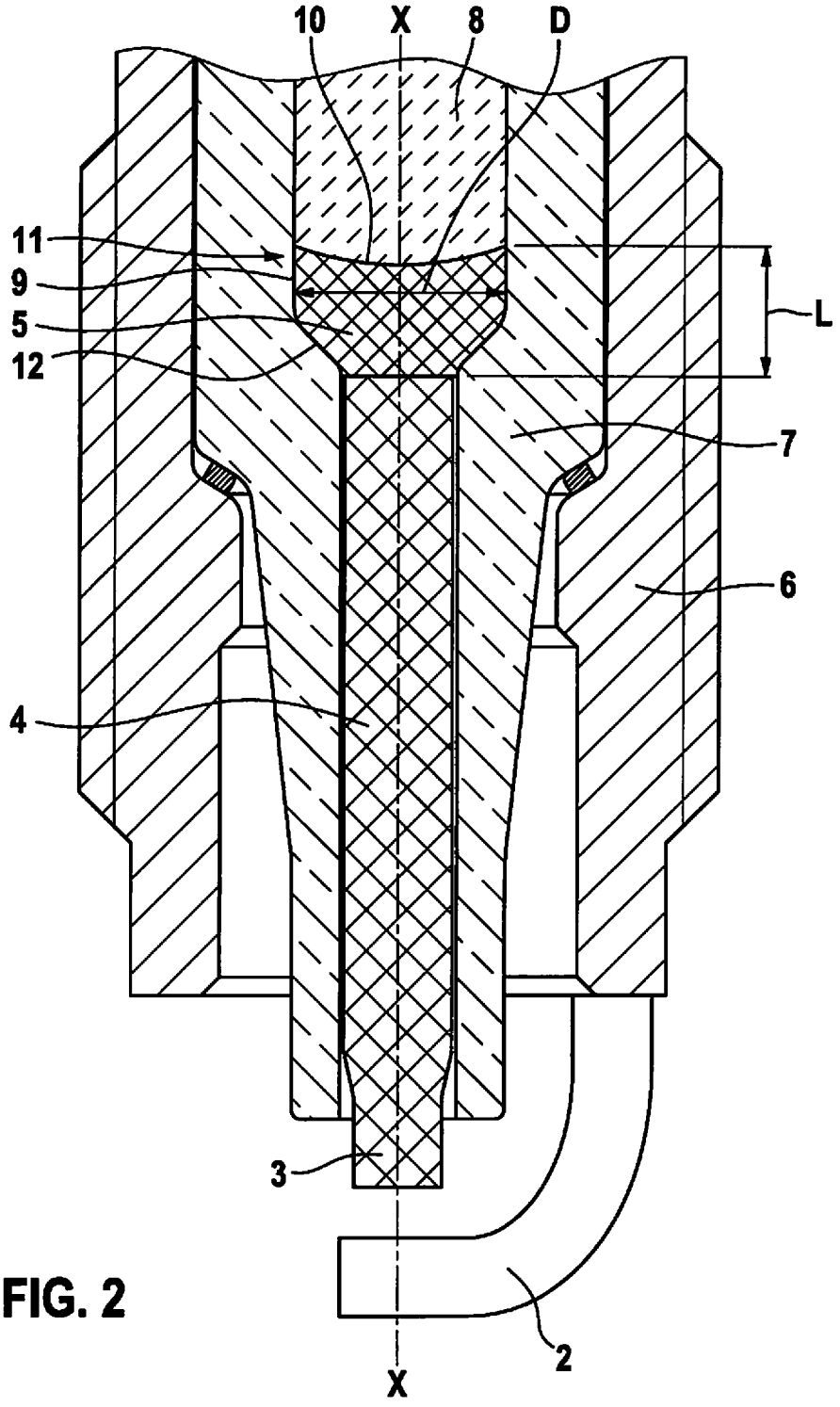
FIG. 2 a sectional view of a segment of the spark plug from FIG. 1.

Heat-conducting contact region 9 is shown in greater detail in FIG. 2. According to the advantageous further refinement depicted there, the entire outer periphery of center-electrode head 5 forms a heat-conducting contact region 9 with ceramic insulator 7. In other words, the entire outer periphery of center-electrode head 5 including its shoulder 12 is in direct contact with insulator 7, so that neither an air gap nor an electrically conductive connection element 8, as in conventional spark plugs, is provided between these components.

For this purpose, a press-fit connection is developed especially between center-electrode head 5 and insulator 7. This also improves the gas tightness of heat-conducting contact region 9 between center-electrode head 5 and insulator 7.

In the axial direction X-X of spark plug 1, heat-conducting contact region 9 advantageously has a length L of at least 1 mm, and in particular of 1.5 to 4.5 mm because this makes it possible to provide an especially large heat-exchange surface between center-electrode head 5 and insulator 7.

In addition, a diameter D of center-electrode head 5 in heat-conducting contact region 9 advantageously amounts to at least 2 mm, and in particular 2 to 4 mm; a ratio L/D of length L of heat-conducting contact region 9 to diameter D of heat-conducting contact region 9 is at least 0.75. Heat-conducting contact region 9 is able to be enlarged to a maximum size by varying ratio L/D as a function of the dimensioning of spark plug 1.

In the direction of its end face 10, center-electrode head 5 has a cup-like region 11, and thus a concave region, which is oriented in the direction of electrically conductive connection element 8. As a result, a particularly large heat-conducting contact region 9 is obtained at a reduced volume of center-electrode head and excellent contacting of electrically conductive connection element 8. Moreover, center electrode 3 is thus form-fittingly seated in the insulator and in electrically conductive connection element 8, so that center electrode 3 is stabilized and centered in ceramic insulator 7.

What is claimed is:

1. A spark plug, comprising:

a ground electrode;

a center electrode; and a ceramic insulator designed to accommodate the center electrode;

wherein the center electrode includes a center-electrode head which lies in a direction of an electrical connection region of the spark plug, the center electrode head having an end face that is in contact with an electrically conductive connection element situated between the electrical connection region and the center-electrode head, and the center-electrode head, at its outer periphery, being at least regionally in heat-conducting contact with the ceramic insulator and forming a heat-conducting contact region, wherein the center-electrode head has a concave surface at the end face.

2. The spark plug as recited in claim 1, wherein the entire outer periphery of the center-electrode head forms a heat-conducting contact region with the ceramic insulator.

3. The spark plug as recited in claim 1, wherein the outer periphery of the center-electrode head is in direct contact with the insulator.

4. The spark plug as recited in claim 1, wherein a press-fit connection is between the center-electrode head and the insulator.

5. The spark plug as recited in claim 2, wherein the heat-conducting contact region between the center-electrode head and the insulator is gas-tight.

6. The spark plug as recited in claim 2, wherein the heat-conducting contact region has a length of at least 1 mm in the axial direction of the spark plug.

7. The spark plug as recited in claim 6, wherein the length is 1.5 to 4.5 mm.

8. The spark plug as recited in claim 1, wherein a diameter of the center-electrode head in the heat-conducting contact region is at least 2 mm.

9. The spark plug as recited in claim 8, wherein the diameter is 2 to 4 mm.

10. The spark plug as recited in claim 1, wherein a ratio a length of the heat-conducting contact region to a diameter of the heat-conducting contact region is at least 0.75.

11. The spark plug as recited in claim 1, wherein a diameter of the center-electrode head is greater than a center-electrode section facing the combustion chamber, and a shoulder, which is in heat-conducting contact with the ceramic insulator, is in a transition region between the center-electrode head and the center-electrode section facing the combustion chamber.

12. The spark plug as recited in claim 1, wherein the center-electrode head has a cup-like region at the end face.

13. A method for producing a spark plug, comprising:

introducing the center electrode into a cavity of a ceramic insulator so that the center-electrode head comes to lie on a shoulder developed in the cavity of the ceramic insulator;

press-fitting the center electrode with the ceramic insulator; and developing a heat-conducting contact region between an outer periphery of the center-electrode head and the ceramic insulator, wherein the center-electrode head has a concave surface at an end face of the center-electrode head.

14. The method as recited in claim 13, wherein the press-fitting is carried out with the aid of a stamp.

15. The method as recited in claim 13, further comprising:

introducing an electrically conductive connection element into the cavity of the ceramic insulator so that the center-electrode head is connected to the electrical connection region of the spark plug in an electrically conductive manner.

* * * * *